US006150574A

United States Patent [19]

Forbus, Jr.

[11] Patent Number: 6,150,574

[45] Date of Patent: Nov. 21, 2000

[54] TRIALKYMETHANE MIXTURES AS SYNTHETIC LUBRICANTS

[75] Inventor: Thomas R. Forbus, Jr., Woodstown, N.J.

[73] Assignee: Mobil Oil Corporation, Fairfax, Va.

[21] Appl. No.: 09/306,091

[22] Filed: May 6, 1999

[51] Int. Cl.[7] ..... C07C 7/20

[52] U.S. Cl. ..... 585/1; 585/16

[58] Field of Search ..... 585/1, 16

[56] References Cited

U.S. PATENT DOCUMENTS 5,091,598 2/1992 Cahiez .
5,157,192 10/1992 Sorensen .
5,316,686 5/1994 Snyder, Jr. .
5,382,705 1/1995 Chung .
5,728,907 3/1998 Squicciarini et al. ..... 385/1

*Primary Examiner*—Jacqueline V. Howard

[57] ABSTRACT

When different trialkyl methanes containing 25 through 36 carbon atoms are mixed the mixture exhibits surprisingly superior lubricant properties including low viscosity, high VI, low volatility, very low pour point and a dynamic viscosity at low temperatures that is less than those of PAO lubricants. Statistically predictable mixture compositions of mixed trialkyl methanes are prepared by reaction of mixtures of n-alkyl organometallic compounds with mixed aliphatic esters or equivalent compounds.

10 Claims, 2 Drawing Sheets

TRIALKYMETHANE MIXTURES AS SYNTHETIC LUBRICANTS

FIELD OF THE INVENTION

This invention relates to novel mixed tri-n-alkyl methane mixtures that have been found to have superior properties as synthetic hydrocarbon lubricant fluids (SHF). The invention also relates to the novel processes for the preparation of the unique tri-n-alkyl methane mixtures. It has been found that the mixed tri-n-alkyl methane mixtures of the invention are unusual in the combinations of properties that they exhibit, including very low viscosity, high viscosity index (VI), unexpectedly low pour point, plus very low dynamic viscosities at low temperature and low volatility.

BACKGROUND OF THE INVENTION

In the last fifty years a large industry has evolved providing synthetic hydrocarbon fluids such as polyalpha olefin (PAO) fluids for a host of lubricant applications. The uniquely superior properties of SHF, particularly PAO fluids, for automotive engine oil lubricant applications have made them a common item of commerce throughout the industrialized world. Polyalphaolefins have traditionally been the synthetic fluids of choice when selecting a SHF for engine lubricant applications for they have offered the best combination of viscosity-temperature relationship with good viscosity index (VI), very low pour point, low viscosity at low temperature, low volatility and excellent thermal stability. Also, alpha-olefins are readily available and readily polymerizable thermally or, most preferably, cationically using Lewis acid catalyst. However, PAO does exhibit certain limitations in that significant branching occurs during polymerization which results in extremely good but less than optimum properties.

It has been established that structural linearity in the lubricant molecule is a preferred structure for optimizing properties. However, structural linearity also promotes solidification of the liquid lubricant at unacceptably high temperatures, i.e., high pour point. Resolving this dilemma has been a major challenge to investigators in the field.

While the degree of branching that occurs in conventional PAO may compromise the potential performance of PAO as a lubricant, a PAO of near-linear structure, HVI-PAO, that provides excellent VI at low pour point has been discovered and reported in U.S. Pat. Nos. 4,827,064 and 4,827,073. HVI-PAO is produced by oligomerization of alpha-olefin with carbon monoxide reduced chromium oxide catalyst on silica support. These PAO oligomers have a methyl-to-methylene branch ratio of less than 0.19 and cover a wide range of viscosities.

Individual trialkyl methane compound are known in the art in pure form including trioctylmethane and tridecylmethane as reported in Research Project 42 report of the American Petroleum Institute Division of Science and Technology, 1940–1967. However, they have melting points (>7° F.) and are therefore unsuitable for lubricant applications.

An object of the present invention is the identification of tri-n-alkylmethane lubricants which have low pour points, good thermal stability, low viscosity, high VI and low volatility.

A further objective of the present invention is to provide a process for the preparation of mixed tri-n-alkyl methane lubricants having the foregoing properties.

SUMMARY OF THE INVENTION

The invention comprises the discovery that when different tri-n-alkyl methanes containing 25 through 36 carbon atoms are mixed the mixture exhibits surprisingly superior lubricant properties including low viscosity, high VI, low volatility, low pour point and low dynamic viscosity at low temperatures that is less than those of conventional PAO lubricants of the same viscosity at 100° C. As a consequence of the unique combination of superior lubricant properties, the trialkyl methane mixtures of the invention have been found to possess unprecedented potential as basestock for cross-graded lubricant formulations from SAE OW-20 to OW-60 viscosity grades.

The substituent normal alkyl groups of each tri-n-alkyl methane component of the mixtures of the invention may be alike or different as selected from $C_2$–$C_{14}$ normal alkyl groups; thereby providing a mixture of tri-n-alkyl methanes containing a group of essentially linear alkyl substituent groups on methane. The tri-n-alkyl methane mixture itself may comprise between 2 and 20 different tri-n-alkyl methane compounds of the same or different carbon number from, and including, 25 to, and including, 36. The preferred trialkyl methane average carbon number is between 26 and 30 with the most preferred average carbon number being 27 or 28.

Specifically, the invention comprises a synthetic hydrocarbon lubricant fluid comprising a mixture of trialkyl methane compounds each having a carbon number between 25 and 36 wherein the trialkyl groups comprise $C_2$–$C_{14}$ normal alkyl groups and the fluid mixture exhibits a kinematic viscosity of less than 5 at 100° C., a viscosity index of at least 130, pour point below −30° C. and a NOACK volatility of less than 18 percent weight loss.

The invention further includes the process for preparing the foregoing tri-n-alkyl methane compositions utilizing organometallic compound addition to the carbonyl group of esters or boron chemistry. The organometallic compounds can be either magnesium Grignard reagents or organolithium compounds. The inventive process is disclosed as a process for the production of a synthetic lubricate fluid having superior low temperature lubricant performance properties and comprises contacting a mixture of between 2 and 20 normal $C_2$–$C_{14}$ alkyl organometallic compounds in aliphatic ether solution at a temperature between −20° C. to 150° C. with at least one lower alkyl ester of a $C_2$–$C_{14}$ linear aliphatic carboxylic acid in a mole ratio of 2 moles of said compounds to 1 mole ester. The reaction product is treated with water to separate a mixture of $C_2$–$C_{14}$ linear trialkyl carbinols. The carbinol mixture is hydrogenated and the saturated hydrocarbon hydrogenation product comprising a mixture of normal trialkyl methanes is recovered.

The process of the invention is the practical illustration of the discovery that when certain preselected mixtures of n-alkyl organometallic compounds are reacted with one or more aliphatic carboxylic acid ester(s), or equivalent derivatives, a statistically predictable mixture composition of tri-n-alkylmethanes is produced exhibiting the aforestated desirable properties of low viscosity, low volatility, high VI, low pour point and low dynamic viscosity at low temperature. The process of the invention is the consequence of the discovery that the reactivity of each of the mixed n-alkyl organometallic compounds in the reaction mixture with the acid derivatives) is such that the composition of the resultant tri-n-alkyl methanes mixture is statistically predictable. Accordingly, by appropriate selection of the alkyl groups comprising the n-alkyl organometallic reactant mixture composition the formation of tri-n-alkyl methanes of low carbon number and hence high volatility can be prevented coincident with preventing the formation of tri-n-alkyl methanes of high carbon number and hence of undesirably high solidification temperature. Surprisingly, a tri-n-alkyl methane mixture so fortuitously tailored through the process of the invention exhibits remarkably superior low temperature lubricant properties while avoiding high volatility and elevated solidification temperature of the tri-n-alkyl methanes composition.

As applied herein, the term organometallic compounds includes conventional Grignard reagents, lithium alkyls and organoboron compounds.

DETAILED DESCRIPTION OF THE INVENTION

Figure 1:
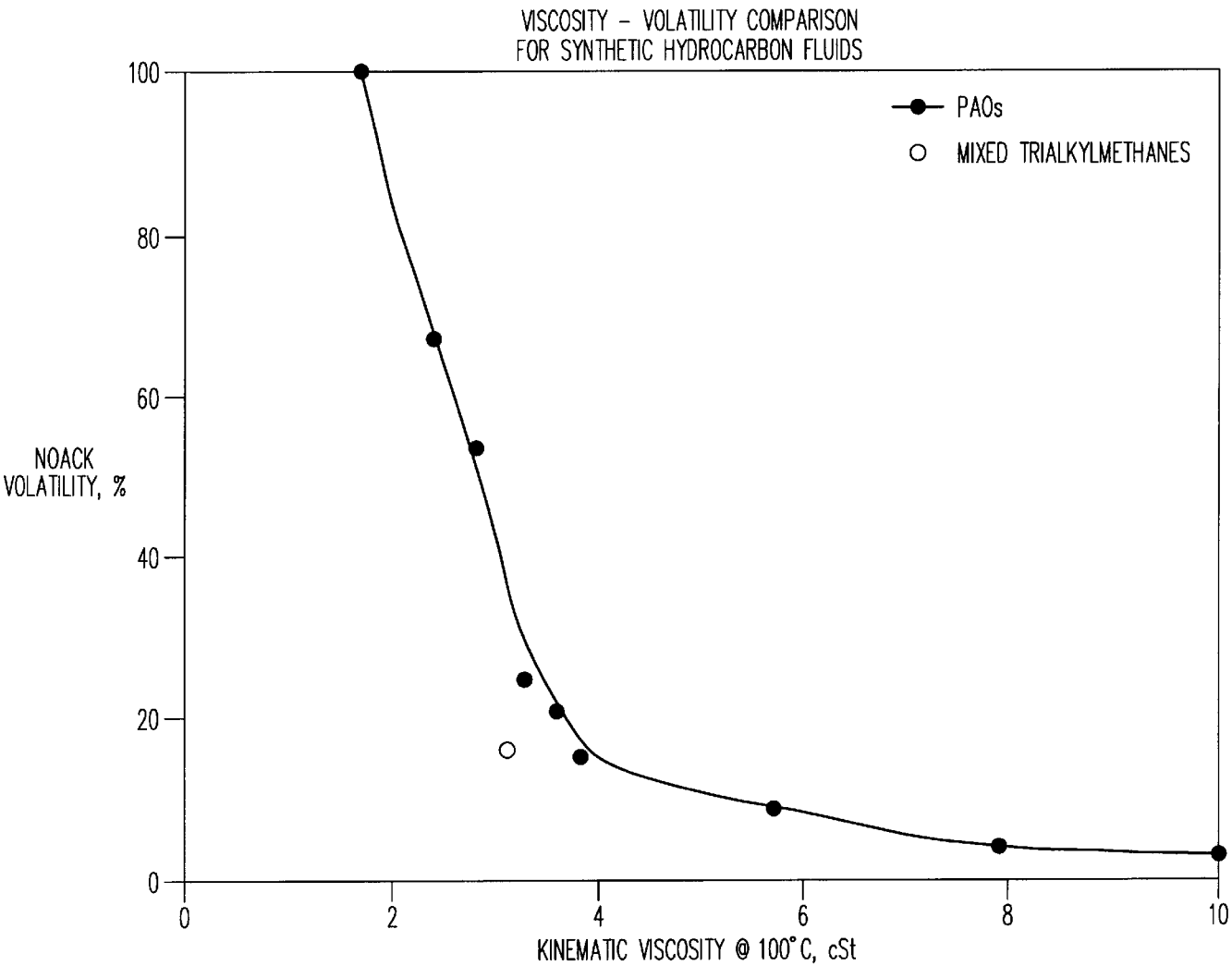
FIG. 1 is graphical plot of NOACK volatility (% weight loss) versus kinematic viscosity at 100° C. for various PAO's in comparison with the mixed tri-n-alkylmethanes of the invention.

A discovery has been made showing that certain mixtures of certain tri-n-alkylmethanes prepared according to the processes of the invention exhibit superior and surprising lubricant properties. The processes of the instant invention yield fluids of mixed hydrocarbons of tight molecular weight distribution and structural similarity. The fluids exhibit very low viscosity, high VI, very low pour point, low volatility and low dynamic viscosity, i.e., a combination of synthetic hydrocarbon lubricant basestock properties which are unavailable by other synthesis means. While polyalphaolefins have dominated synthetic lubricant applications heretofore, the synthetic hydrocarbon basestocks of the present invention as available through the processes of the invention can provide a combination of properties not matched by currently available PAO technology. They have been found to provide a key to the formulation of low viscosity, high energy efficient engine oils of wide cross-grade exhibiting good volatility performance. Accordingly, they could allow for a more economical use of higher viscosity mineral oils with better volatility characteristics in order to make widely cross-graded oils with good volatility characteristics.

The trialkylmethane molecules of the invention are pyramid-shaped which is a substantial departure from the branched PAO molecules employed as synthetic lubricants in the prior art. Their pyramidal structure, when employed as a mixture of trialkylmethanes, accounts in large part for the cited unexpected combination of favorable lubricant properties. Molecules of this shape also lend themselves to achieving higher stability toward thermal and thermo-oxidative degradation due to their lack of vicinal alkyl branches and the presence of only one tertiary carbon per molecule. It is known that conventional PAO has a branch index, i.e., $CH_3/CH_2$ ratio, of greater than 0.20 and each tertiary alkyl branch in the molecule is a target for oxidative/thermal degradation. The site opportunities for oxidation in PAO are much greater than those in the mixtures of the invention so that, where these mixtures can be prepared to meet applied lubricant specifications, they can be expected to demonstrate a high degree of thermal and oxidative stability.

In view of the noted better stability of linear over branched hydrocarbon structures it is much preferred that all of the alkyl groups in all of the trialkymethanes comprising the mixtures of the invention be linear or normal alkyl groups. However, without departing from the spirit of the invention, it is recognized that some of the alkyl groups on specific components of the mixture may themselves bear alkyl branches. Indeed, the mixture may include one or more trialkylmethane components of the mixture wherein all of the alkyl groups on those specific trialkylmethanes bear one or more alkyl branches. This option has certain advantages.

Besides affecting stability, branching, it is known, also affects viscometric properties such as VI. If a given lubrication application does not require good thermal stability but, for example, does require an especially low pour point, an artisan may well elect to modify the mixture of the invention to favor trialkymethanes wherein a proportion of, all or essentially all of the alkyl groups of the trialkymethanes comprise branched alkyl groups. This is within the scope of the invention.

The preferred alkyl substituent groups in the trialkylmethanes comprise $C_2$–$C_{14}$ normal alkyl groups such as ethyl, n-propyl, n-butyl, n-hexyl, n-octyl, n-nonyl, n-decyl, n-dodecyl, and the like. Preferably, the trialkyl substituents on methanes comprise n-octyl or higher alkyl groups. The alkyl groups on a specific trialkylmethane may be alike or different such as, for example, ethyl-di-n-dodecylmethane, tri-n-decylmethane, n-octyl-di-n-nonylmethane and the like.

In any event, whatever combination of alkyl groups is substituted on methane, the carbon number of each trialkylmethane in the mixture of trialkylmethanes of the invention is between 25 and 36. In this way it can be assured that the mixture will have a high volatility by avoiding compounds with molecular weights below a carbon number of 25 and also avoid high pour points by avoiding the inclusion of compounds with a molecular weight higher than a carbon number of 36. The preferred carbon number is between 26 and 32 and the most preferred carbon number is 27–28, particularly 28.

The number of different trialkylmethanes in the mixture of trialkylmethanes is very important as it has been found that both the number and composition of different trialkylmethanes in the mixture determines the lubricant properties of the mixture and distinguishes the invention over all others. As a direct consequence, tailoring the combinations of the number and composition variables allows the artisan to modify the lubricant properties to accommodate a targeted lubricant application. Between 2 and 27 different trialkylmethanes can be included in the trialkylmethane mixture; preferably between 2 and 20 and most preferably between 4 and 7.

From the foregoing it can be appreciated that the preferred embodiments of the invention comprise mixtures of trialkylmethanes containing between 4 and 7 different trialkylmethanes wherein each trialkylmethane contains between 25 and 36 carbon atoms, preferably 27–28.

Having discovered the lubricant value of mixed trialkylmethanes, one approach to prepare the mixtures of the invention is to separately prepare individual trialkylmethane compounds of a requisite composition and then physically mix these individual compounds to obtain a preferred mixture composition having the selected lubricant properties. However, this possible approach to the preparation of the individual trialkylmethanes of the invention is a tedious process and economically unrealistic. While the mixtures of the invention can offer advantages over PAO in low temperature and low viscosity lubricant applications, to be of commercial use the advantages must be considered within the context of PAO marketplace economics. To that end, the novel processes of the instant invention have been developed wherein the preferred trialkylmethane lubricant mixtures are prepared in essentially a single key process step that is compatible with a more favorable and useful approach to overall process economics.

The invention comprehends the discovery that the novel lubricants comprising certain mixtures of trialkylmethanes can be prepared by unobvious adaptations of processes employing applications of organometallic chemistry. Specifically, it has been discovered that two fields of organometallic chemistry can be modified to provided processes useful in the preparation of the trialkylmethane mixtures, i.e., borane and Grignard chemistry.

Borane chemistry is very well known in the organic chemical arts. As to its application with respect to the instant invention, reference is made to "Comprehensive Organometallic Chemistry" by Wilkinson, vol. 7, pp 125, 282–285. Carbonylation of alkylborans is reported by M. E. D. Hillman in J.A.C.S., 1962, vol. 84, pp 4715- and by H. C. Brown, et al. in J.A.C.S., 1967, vol. 89, pp 2737–38 & 4528. The fundamentals of Grignard chemistry are even more widely known than those of boran chemistry.

It has been discovered that either borane chemistry or Grignard chemistry can be employed to prepare mixtures of trialkylmethanes of predictable compositions consistent with the foregoing compositions found to be useful as improved lubricant fluids. The borane synthesis method involves the addition to borane of a mixture of olefins preferably chosen from among those having carbon numbers of 8 to 11. The alkylboranes so formed are then combined with carbon monoxide and water and heated to carry out the carbonylation of the alkylborane to form the symmetrical trialkylmethyl boron oxide cyclic trimer. The trialkyl carbon group on the trimer can then be split from boron by reductive cleavage to yield the desired hydrocarbon or oxidatively cleaved to yield the trialkylcarbinol. Trialkylcarbinol can then be hydrogenated in the presence of a small amount of a strong acid to yield the trialkyls methanes. Optionally, the higher alkylboranes can be prepared by an exchange of the higher molecular weight olefins with the alkyl groups of lower molecular weight alkylborane followed by carbonylation to form the trimer as described in the cited literature.

The second synthesis method involves the addition of mixed organometallic reagents to the carbonyl group of either carbonate derivatives, organoesters, ketones or their functional equivalents to yield a mixture of mixed trialkylcarbinols. The trialkylcarbinols can be hydrogenated in the presence of acid to form hydrocarbon mixtures. The preferred organometallic reaction method is the Grignard reaction using mixtures of magnesium alkyl halides to add to the carbonyl carbon of mixtures of carboxylic acid esters or their equivalent derivatives to form the mixture of mixed trialkylcarbinols for subsequent hydrogenation to a mixture of mixed trialkylmethanes.

Whatever process chemistry is pursued, boron chemistry or organometallic chemistry, it has been found that the sought for goals of lubricant performance properties and process economics can be realized only when a statistically predictable mixture of alkylmethanes is prepared containing mixed trialkylmethanes having a carbon number between 25 and 36. The breakthrough inherent in the invention is the discovery that such mixtures can be attained by preparing a preferred mixture of Grignard reagents and reacting that known mixture with a known mixture of carboxylic acid esters or other derivatives of carboxylic acids to yield a statistically predictable mixed alkyl mixture of trialkylcarbinols which can be reduced to provide a mixture of mixed trialkylmethanes having the predicted composition and attendant properties.

Two mixed tri-n-alkyl methane fluids were prepared to illustrate the discovery of the instant invention showing that such mixed trialkylmethanes have an unusually combination of low viscosity and low volatility plus high VI and low pour point. The mixed trialkylmethanes were synthesized by reaction of mixed Grignard reagents with mixed n-alkyl carboxylic acid esters to form the tri-n-alkylmethanols, followed by hydrogenation in the presence of strong acid to produce the alkane equivalent, i.e., the mixed tri-n-alkylmethanes fluid. The following detailed non-limiting Examples illustrate the process and products of the invention:

EXAMPLE 1

All C25–C31 Odd-numbered Carbon fluids

A 1:1 molar ratio mixture of n-octyl and n-decyl Grignard reagents was combined with a 1:1 molar ratio mixture of methyl undecanoate and methyl nononate esters, in amount sufficient to provide a 2:1 molar ratio of Grignard regents to esters in the reaction mixture, by adding the esters to the Grignard solution while maintaining the reaction temperature below 30° C. The reaction product was treated with excess dilute sulfuric acid to produce, after solvent stripping, an essentially quantitative yield of a mixture of mixed tri-n-alkylcarbinols containing $C_{25}$, $C_{27}$, $C_{29}$, and $C_{31}$ carbon atoms in a carbon number mole ratio of approximately 1:2:2:1 as determined by gas chromatography and carbon analysis. The carbon number mixture mole ratio recovered agrees with that predicted by statistical analysis of the probable combinations of the mixed reactants of the esters/Grignard reaction mixture. The mixture was hydrogenated neat at 200° C. and 1,000 psig in an autoclave using palladium-on-carbon with a small amount of p-toluenesulfonic acid (dehydration catalyst) to give the corresponding hydrocarbons, i.e., a mixture of mixed tri-n-alkyl methanes.

EXAMPLE 2

C25–C31 All-numbered Carbon Fluids

A mixed trialkylcarbinol mixture was synthesized as described in Example 1 using a 1:1:1 molar ratio mixture of n-octyl, n-nonyl and n-decyl Grignards reagents in ether solution. The mixture of Grignard reagents was reacted with a 1:1:1 molar ratio mixture of methyl undecanoate, methyl decanoate and methyl nononate esters wherein the molar ratio of Grignard reagents to esters in the reaction mixture was 2:1. The combination of these reactant mole ratios produced trialkylcarbinols having $C_{25}$, $C_{26}$, $C_{27}$, $C_{28}$, $C_{29}$, $C_{30}$ and $C_{31}$ carbon atoms in a carbon number mole ratio of approximately 1:2:3:3:3:2:1 as determined by gas chromatography and carbon analysis. As in Example 1, the carbon number mixture mole ratio recovered in Example 2 agrees with that predicted by statistical analysis of the most-probable combinations of the mixed reactants of the esters/Grignard reaction mixture of Example 2. The tricarbinol mixture was hydrogenated neat as in Example 1 to give the corresponding mixture of hydrocarbons, i.e., a mixture of mixed tri-n-alkylmethanes.

From Examples 1 and 2, it is evident that a statistically predetermined carbon number mixture of trialkylmethanes can be prepared by a suitable selection of a mixture of reactant Grignard reagents and aliphatic carboxylic acid esters followed by hydrogenation of the resultant carbinol mixture. Consequently, the scope of the invention is not limited merely to the products of the Examples presented. The process of the invention provides the opportunity to predetermine or vary the composition of the mixture of trialkylmethanes produced consistent with an ability to modify and optimize the lubricant properties of the fluid for the intended lubricant application.

The rheological and other physical properties of the fluids of Examples 1 and 2 are tabulated in Table 1 in comparison with other low viscosity synthetic hydrocarbon fluids. The other SHF's are polyalphaolefins or related fluids of low viscosity produced by various acid catalyzed dimerization/polymerization processes using promoted boron trifluoride catalysts. Relative to PAO and PAO-type fluids, the mixed trialkylmethane fluids of Examples 1 and 2 show a combination of:

Lower kinematic viscosity, 3.1 cS @ 100° C.

Comparable high VI (135).

Unexpectedly low pour point (−40° C.)

Lower volatility/viscosity relationship, 16% as measured by the NOACK test.

Exceptionally low dynamic viscosity (by Crank Case Simulator; CCS) at low temperatures.

In Table 1, the two hydrocarbon fluids of the invention (C8–10 mixed tri-alkylmethanes) show a superior combination of low volatility at low kinematic viscosity compared to conventional PAO fluids. They also show a shape advantage in Cold Crank Simulator results over PAO. These improvements have been obtained while still exhibiting a high VI and very low pour point.

Figure 2:
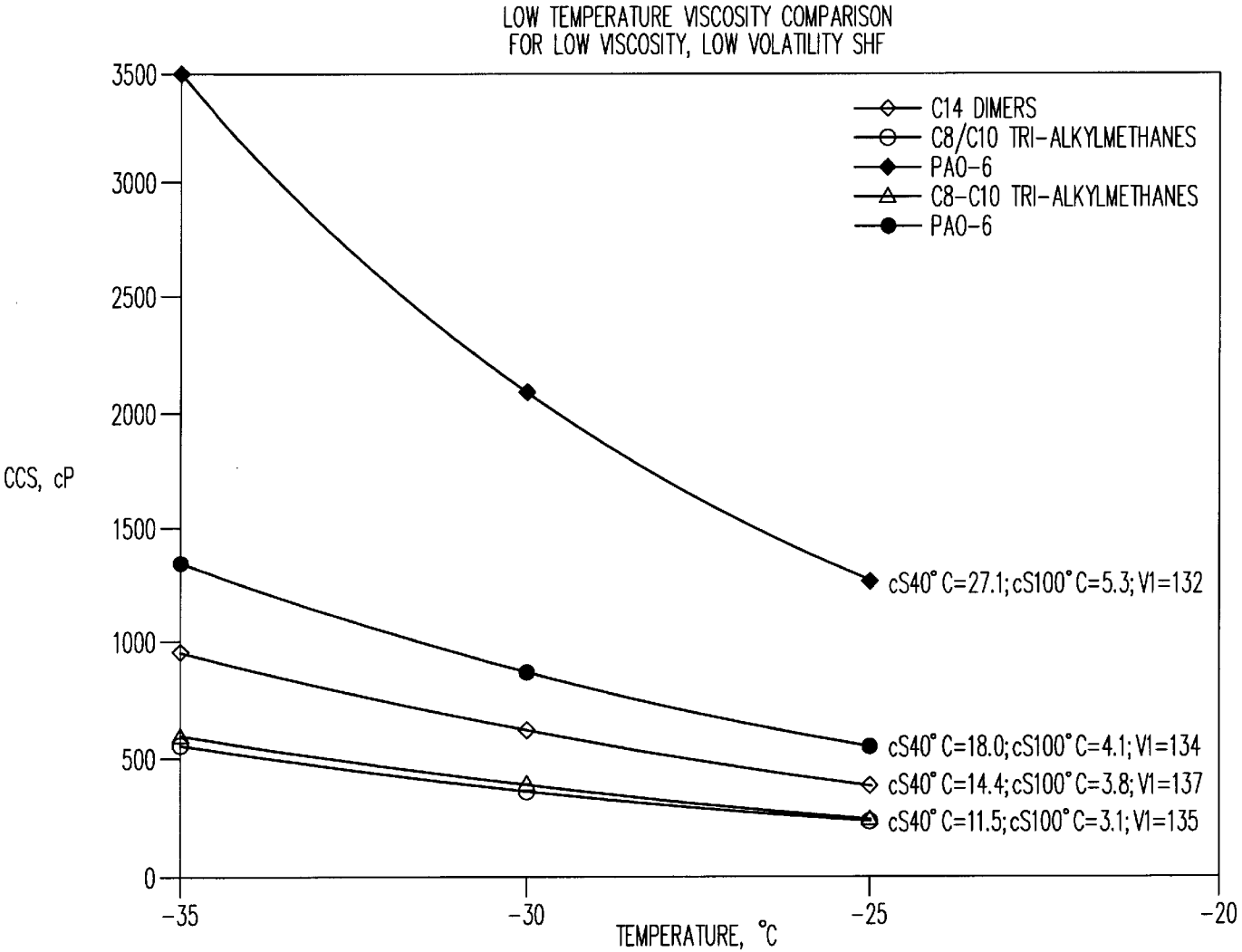
FIG. 2 is a graphical plot of Crank Case Simulator (CCS) dynamic viscosity versus temperature for various conventional PAO lubricants in comparison with the mixed trialkymethane lubricants of the invention.

The superiority of the fluids of the invention over PAO is also evident by referring to the graph in FIG. 1 where the data point for the composition of the invention is shown to be well outside the viscosity/volatility curve of PAO's. FIG. 2 is another illustration of the unexpected superiority of the fluids of the invention over low molecular weight PAO or dimers of alpha olefins. At very low temperatures the CCS viscosity of the fluids of the invention is remarkably and unexpectedly much lower than those of PAO. These important differences highlight the unexpectedness and unobviousness of the instant invention; an achievement remarkable in that it has been shown that mixtures of trialkylmethanes not only overcome the known liabilities and lack of utility of individual trialkylmethane as lubricant fluids but provide superior lubricant properties well beyond the predictable.

TABLE 1

| | Laboratory Tests | | | | | | | |
|---|---|---|---|---|---|---|---|---|
| Component | Kine. vis | Kine. vis. | | Cold Crank Simulator, cP | | | Pour Point | NOACK Volatility |
| 100 wt. % | 40° C., cS | 100° C., cS | VI | −25° C. | −30° C. | −35° C. | ° C. | %, loss |
| PAO-6[1] | 28.37 | 5.51 | 135 | 1280 | 2091 | 3475 | −65 | 8.8 |
| C14-based PAO[2] | 14.40 | 3.60 | 137 | 396 | 619 | 956 | −36 | 18.8 |
| C16-based PAO[2] | 20.30 | 4.64 | 152 | 836 | 2442 | 19554 | −18 | |
| C14/16-base PAO[2] | 18.00 | 4.12 | 134 | 549 | 927 | 1745 | −24 | |
| C8/10 mixed TAM[3] | 11.48 | 3.10 | 135 | 232 | 365 | 558 | −40 | 16.0 |
| C8–C10 mixed TAM[4] | 11.26 | 3.06 | 135 | 241 | 387 | 583 | −40 | |
| PAO-4[1] | 16.53 | 3.87 | 130 | 556 | 865 | 1346 | −65 | 13.0 |

[1]1-decene based PAO, [2]85% dimer/15% trimer, [3]octyl & decyl mixed trialkylmethane mixture, [4]Octyl, nonyl and decyl mixed trialkylmethane mixture.

What is claimed is:

1. A synthetic hydrocarbon lubricant fluid comprising a mixture of mixed tri-n-alkyl methane compounds each having a carbon number between 25 and 36 wherein the alkyl groups comprise $C_2$–$C_{14}$ normal alkyl groups and the fluid mixture exhibits a kinematic viscosity of less than 5 at 100° C., a viscosity index of at least 130, pour point below −30° C. and a NOACK volatility of less than 18% weight loss.

2. The lubricant fluid of claim 1 wherein the mixture includes between 2 and 20 different trialkyl methane compounds of the same or different carbon number.

3. The lubricant fluid of claim 2 wherein the mixture includes between 4 and 7 trialkyl methane compounds.

4. The lubricant fluid of claim 1 wherein the trialkyl methane compounds have a carbon number between 26 and 30.

5. The lubricant fluid of claim 4 wherein the carbon number is predominately 27 to 28.

6. The lubricant fluid of claim 1 wherein the normal alkyl groups comprise between $C_8$–$C_{12}$ normal alkyl.

7. The lubricant fluid of claim 6 wherein the alkyl groups are $C_8$–$C_{10}$ normal alkyl.

8. The lubricant fluid of claim 1 having a dynamic viscosity at −25° C. of less than 300 cP determined by Cold Crank Simulator test.

9. A process for the production of a synthetic lubricate fluid having superior low temperature lubricant performance properties comprising:

reacting a mixture of between 2 and 20 normal $C_2$–$C_{14}$ alkyl organometallic compounds in aliphatic ether solution by carbonyl addition to at least one lower alkyl ester of a $C_2$–$C_{14}$ linear aliphatic carboxylic acid in a mole ratio of 2 moles of said compounds to 1 mole of ester(s);

treating the reaction product with water and separating a mixture of tri-n-alkyl carbinols;

hydrogenating the carbinol mixture and recovering the saturated hydrocarbon hydrogenation product of a mixture of mixed normal trialkyl methanes comprising the synthetic lubricant fluid.

10. The process of claim 9 wherein said organometallic is a mixed Grignard reagent and the carbinol is hydrogenated in contact with palladium and hydrogen.

* * * * *